US007060149B2

(12) United States Patent
Ortega et al.

(10) Patent No.: US 7,060,149 B2
(45) Date of Patent: Jun. 13, 2006

(54) NONWOVEN FABRICS WITH ADVANTAGEOUS PROPERTIES

(75) Inventors: Albert E. Ortega, Pensacola, FL (US); R. Wayne Thomley, Pensacola, FL (US); Jan Mackey, Gulf Breeze, FL (US)

(73) Assignee: The Procter & Gamble Company, Cincinnati, OH (US)

( * ) Notice: Subject to any disclaimer, the term of this patent is extended or adjusted under 35 U.S.C. 154(b) by 106 days.

(21) Appl. No.: 09/894,580

(22) Filed: Jun. 28, 2001

(65) Prior Publication Data

US 2001/0055682 A1 Dec. 27, 2001

Related U.S. Application Data

(62) Division of application No. 09/397,330, filed on Sep. 14, 1999, now abandoned.

(60) Provisional application No. 60/100,192, filed on Sep. 14, 1998.

(51) Int. Cl.
*D01D 5/08* (2006.01)
*D01D 5/10* (2006.01)

(52) U.S. Cl. ..... 156/167; 156/180; 156/181; 156/290

(58) Field of Classification Search ..... 156/167, 156/180, 181, 290
See application file for complete search history.

(56) References Cited

U.S. PATENT DOCUMENTS

| | | | | | |
|---|---|---|---|---|---|
| 3,811,445 | A | * | 5/1974 | Dostal | 604/375 |
| 3,853,659 | A | | 12/1974 | Rhodes | |
| 3,968,307 | A | | 7/1976 | Matsui et al. | |
| 4,052,146 | A | | 10/1977 | Sternberg | |
| 4,078,340 | A | * | 3/1978 | Klecker et al. | 51/295 |
| 4,082,878 | A | * | 4/1978 | Boe et al. | 428/195.1 |
| 4,107,364 | A | | 8/1978 | Sisson | |
| 4,292,984 | A | | 10/1981 | Sawada et al. | |
| 4,406,850 | A | | 9/1983 | Hills | |
| 4,424,257 | A | | 1/1984 | Bach | |
| 4,424,258 | A | | 1/1984 | Bach | |
| 4,610,962 | A | * | 9/1986 | Takagi et al. | 435/179 |
| 4,830,904 | A | | 5/1989 | Gessner et al. | |
| 5,288,544 | A | * | 2/1994 | Mallen et al. | 442/198 |
| 5,382,400 | A | * | 1/1995 | Pike et al. | 264/168 |
| 5,431,986 | A | | 7/1995 | Ortega et al. | |
| 5,489,469 | A | * | 2/1996 | Kobayashi et al. | 442/393 |
| 5,534,339 | A | | 7/1996 | Stokes | |
| 5,660,910 | A | | 8/1997 | Hoyt et al. | |
| 5,669,799 | A | * | 9/1997 | Moseneder et al. | 442/374 |
| 5,674,339 | A | * | 10/1997 | Groeger et al. | 156/145 |
| 5,679,042 | A | | 10/1997 | Varona | |
| 5,685,757 | A | | 11/1997 | Kirsch et al. | |
| 5,752,945 | A | | 5/1998 | Mosley et al. | |
| 5,783,503 | A | | 7/1998 | Gillespie et al. | |
| 5,853,635 | A | | 12/1998 | Morell et al. | |
| 5,879,487 | A | * | 3/1999 | Ravella | 156/62.8 |
| 5,895,710 | A | | 4/1999 | Sasse et al. | |
| 5,913,993 | A | | 6/1999 | Ortega et al. | |
| 5,951,535 | A | * | 9/1999 | Fujiwara et al. | 604/384 |
| 5,965,468 | A | | 10/1999 | Marmon et al. | |
| 6,001,751 | A | | 12/1999 | Pereira et al. | |
| 6,074,590 | A | | 6/2000 | Gownder | |
| 6,207,276 | B1 | | 3/2001 | Spindler et al. | |
| 2003/0049988 | A1 | | 3/2003 | Ortega et al. | |
| 2003/0104747 | A1 | | 6/2003 | Ortega et al. | |

FOREIGN PATENT DOCUMENTS

| | | |
|---|---|---|
| EP | 0381206 B1 | 8/1990 |
| EP | 0 421 649 A1 | 4/1991 |
| EP | 0 822 284 A2 | 2/1998 |
| JP | 08260323 | 8/1996 |
| WO | WO 98/30744 A1 | 7/1998 |
| WO | WO 99/23285 A1 | 5/1999 |

* cited by examiner

*Primary Examiner*—Sam Chuan Yao
(74) *Attorney, Agent, or Firm*—Eric T. Addington; Dara M. Kendall; Ken K. Patel

(57) ABSTRACT

This invention relates to nonwoven fabrics with advantageous characteristics and the method to produce these fabrics. Advantageously, the fabrics of the subject invention have increased thickness (loft) compared to conventional nonwoven fabrics and have high air permeability and open space while maintaining softness and strength at the same basis weight.

7 Claims, No Drawings

NONWOVEN FABRICS WITH ADVANTAGEOUS PROPERTIES

CROSS-REFERENCE TO A RELATED APPLICATION

This application is a divisional of U.S. patent application Ser. No. 09/397,330, filed Sep. 14, 1999 now abandoned; which claims priority from provisional application U.S. Ser. No. 60/100,192, filed Sep. 14, 1998.

FIELD OF THE INVENTION

This invention relates to new nonwoven fabrics having advantageous properties. The fabrics have unique filament characteristics which impart improved properties to the fabrics.

BACKGROUND OF THE INVENTION

Nonwoven fabrics and numerous uses thereof are well known to those skilled in the textiles art. Such fabrics can be prepared by forming a web of continuous filament and/or staple fibers and bonding the fibers at points of fiber-to-fiber contact to provide a fabric of requisite strength. The term "bonded nonwoven fabric" is used herein to denote nonwoven fabrics wherein a major portion of the fiber-to-fiber bonding is adhesive bonding accomplished via incorporation of adhesives in the web to "glue" fibers together or autogenous bonding such as obtained by heating the web or by the use of liquid or gaseous bonding agents (usually in conjunction with heating) to render the fibers cohesive. In effecting such bonding, particularly autogenous bonding, the web may be subjected to mechanical compression to facilitate obtaining adequate bonding. Mechanical compression normally sets the loft or thickness of fabrics with similar basis weights. It is well known that thickness is increased by increasing the basis weight, or the mass per square area.

Spunbonded nonwoven fabrics formed of nylon, polyester, polypropylene, or other man-made polymers are widely used commercially for a number of purposes. Such fabrics exhibit excellent strength and permeability properties and accordingly are desirable for use in construction fabrics, filtration material, and furniture and bedding backing materials.

The fabrics are produced via the well-known spunbonding process in which molten polymer is extruded into filaments, and the filaments are attenuated and drawn pneumatically and deposited onto a collection surface to form a web. The filaments are bonded together to produce a strong, coherent fabric. Filament bonding is typically accomplished either thermally or chemically, i.e., autogenously. Thermal bonding is accomplished by compression of the web of filaments between the nip of a pair of cooperating heated calender rolls thereby setting the thickness. In autogenous bonding of nylon filaments, the web of filaments is transported to a chemical bonding station or "gashouse" which exposes the filaments to an activating agent (i.e., HCl) and water vapor. Water vapor enhances the penetration of the HCl into the filaments and causes them to become tacky and thus amenable to bonding. Upon leaving the bonding station, the web passes between rolls which compress and bond the web thereby setting the thickness. Adequate bonding is necessary to minimize fabric fuzzing (i.e., the presence of unbonded filaments) and to impart good strength properties to the fabric. Autogenous bonding has been used extensively in forming spunbonded nylon industrial fabrics.

Nonwoven fabrics which are strongly bonded overall (for example, by uniform compression of the entire web in the presence of heat and/or appropriate bonding agents) tend to be stiff and boardy and are frequently more similar to paper than to woven textile fabrics. In order to obtain softer nonwoven fabrics more closely simulating woven fabrics, nonwoven "point-bonded" fabrics have been prepared by processes which tend to limit bonding to spaced, discrete areas or points. This is accomplished by application or activation of an adhesive or bonding agent and/or application of heat and/or pressure at the points where bonding is desired. For example, the web to be bonded can be compressed between a pair of rolls or platens, at least one of which carries bosses or a land and groove, design sized and spaced to compress the web at the desired points. The compression device can be heated to effect thermal bonding of the web fibers or to activate a bonding agent applied to the web.

In the actual practice of preparing point-bonded fabrics, however, it is frequently difficult or even impossible to limit bonding to the desired points. In many processes, web areas between the desired bond points are subjected to sufficient heat, compression, activated bonding agent, or adhesive to effect "tack" bonding of fibers outside the desired bond points. Such tack bonding is believed to contribute significantly to undesired fabric stiffness.

It has been found that most point-bonded nonwoven fabrics, particularly those having a large number of tack bonds, and many overall bonded nonwoven fabrics can be significantly softened by subjecting the fabric to mechanical stress. For example, the fabric can be washed in conventional domestic washing machines, drawn under tension over a sharply angled surface such as a knife blade, stretched, twisted, crumpled, or subjected to various combinations of such treatments. Such treatments are believed to effect softening primarily by breaking weaker fiber-to-fiber bonds such as tack bonds which can be broken without breaking the point- or intentionally-bonded fibers. These methods are relatively effective but subject to certain practical problems. For example, drawing a nonwoven fabric over a knife blade with sufficient force to effect substantial softening frequently results in an undesirably high level of physical damage to the fabric. Washing of nonwoven fabrics generally yields good results, but is a batch operation not typically adaptable for use in continuous processes of the type employed commercially for production of nonwoven fabrics.

Another method for softening nonwoven fabrics is by impinging the fabric with a fluid jet. This is, however, an additional and potentially cumbersome production step, resulting in increased manufacturing costs.

It is apparent that a commercially practical process for a simpler, more cost-effective method for the softening of nonwoven fabrics while maintaining other advantageous physical properties such as strength and thickness would satisfy a long-felt need in the nonwoven textile art.

Thickness (loft) of nonwoven fabrics is normally determined by the basis weight. Increasing the basis weight adds cost due to the use of more raw materials. It is desirable to have increased thickness (loft) in some applications where these fabrics are used without increasing the basis weight.

Openness (air permeability) of nonwoven fabrics is also normally determined by the basis weight and method of bonding. In some applications, it is desirable to have a fabric with increased openness (air permeability) in some applications without increasing the basis weight.

Nonwoven fabrics are also used in a variety of coating applications. Coating materials will be captured and held more effectively onto a fabric that is more open. Fabrics that use less coating to effect the same desired results would be more cost effective. Fabrics with greater fiber surface area can also increase the effectiveness of the coating process.

BRIEF SUMMARY OF THE INVENTION

The subject invention concerns a novel improved process for producing nonwoven fabrics with improved characteristics. The subject invention further pertains to the fabric produced by the process described herein. In an embodiment specifically exemplified herein, the nonwoven fabric of the subject invention is made of nylon.

Specifically, the subject invention provides a process for providing fabrics which have desired characteristics in terms of thickness, permeability, tensile strength, and hand (softness). In a preferred embodiment, the production of a nonwoven nylon fabric is improved by modifying the denier per filament (dpf). An important advantage of the process of the subject invention is that it provides a fabric with enhanced thickness, open space, and permeability while maintaining excellent strength and desirable softness characteristics of the nonwoven fabric.

In specific embodiments, the fabrics of the subject invention can have round filaments, crescent filaments, multilobal filaments, diamond filaments and/or hollow filaments. The multilobal filaments have at least two lobes and, preferably, three or more lobes. In a preferred embodiment the filaments are trilobal. The use of multilobal filaments is particularly advantageous for maximizing coatings since these filaments have more surface area.

The fabrics of the subject invention may have a dpf ranging from about 0.5 dpf to about 20 dpf. In another preferred embodiment, round filaments will be from about 4 to about 12 dpf and multilobal filaments will be from about 5 to about 12 dpf.

DETAILED DISCLOSURE OF THE INVENTION

In the following detailed description of the subject invention and its preferred embodiments, specific terms are used in describing the invention; however, these are used in a descriptive sense only and not for the purpose of limitation. It will be apparent to the skilled artisan having the benefit of the instant disclosure that the invention is susceptible to numerous variations and modifications within its spirit and scope.

The present invention concerns a process to produce spunbonded nonwoven fabrics with advantageous properties. The subject invention further concerns the fabrics produced according to the subject processes.

Advantageously, the fabrics of the subject invention have increased thickness (loft) compared to conventional nonwoven fabrics and have high air permeability and open space while maintaining softness and strength at the same basis weight. The weight of the fabric of the subject invention will typically be between about 0.2 ounces per square yard and about 7 ounces per square yard. In a preferred embodiment, the weight of the fabric produced as described herein is about 0.5 ounce per square yard. The advantageous characteristics of the fabrics of the subject invention are achieved utilizing filaments having round, crescent, diamond, hollow, and/or multilobal cross-sections.

In one embodiment, the fabrics of the present invention comprise at least two different denier sizes of filaments wherein the larger denier filaments comprise at least about 5% of the filaments. Preferably, the larger denier filaments comprise at least about 25% of the filaments. More preferably, the larger denier filaments comprise at least about 28.5% of the filaments.

In a preferred embodiment the fabrics of the subject invention can contain round and/or trilobal cross sections. The denier per filament (dpf) can be modified as described herein to give desired characteristics. Table 1 lists characteristics of specific fibers which can be used according to the subject invention.

TABLE 1

Cross Section and Expected DPF of Novel Nonwoven Fabrics

| Item | Bottom side of Fabric Cross Section | Bottom Side DPF | Top Side of Fabric Cross section | Top Side DPF | Thickness (mils) | Air Permeability | Basis Weight (osy) |
|---|---|---|---|---|---|---|---|
| 1 | ROUND | 4 | ROUND | 4 | 6.48 | 1039 | 0.490 |
| 2 | ROUND | 4 | ROUND | 12 | 7.26 | 1241 | 0.506 |
| 3 | ROUND | 4 | TRILOBAL | 5 | 6.48 | 1028 | 0.546 |
| 4 | ROUND | 4 | TRILOBAL | 12 | 7.19 | 1233 | 0.484 |
| 5 | ROUND | 12 | ROUND | 4 | 9.13 | 1213 | 0.472 |
| 6 | ROUND | 12 | ROUND | 12 | 7.47 | 1280 | 0.474 |
| 7 | ROUND | 12 | TRILOBAL | 5 | 9.66 | 1185 | 0.537 |
| 8 | ROUND | 12 | TRILOBAL | 12 | 8.39 | 1376 | 0.470 |
| 9 | TRILOBAL | 5 | ROUND | 4 | 6.41 | 1049 | 0.530 |
| 10 | TRILOBAL | 5 | ROUND | 12 | 7.36 | 1204 | 0.527 |
| 11 | TRILOBAL | 5 | TRILOBAL | 5 | 6.70 | 1069 | 0.521 |
| 12 | TRILOBAL | 5 | TRILOBAL | 12 | 6.82 | 1195 | 0.470 |
| 13 | TRILOBAL | 12 | ROUND | 4 | 8.08 | 1165 | 0.511 |
| 14 | TRILOBAL | 12 | ROUND | 12 | 8.05 | 1454 | 0.483 |
| 15 | TRILOBAL | 12 | TRILOBAL | 5 | 8.88 | 1121 | 0.506 |
| 16 | TRILOBAL | 12 | TRILOBAL | 12 | 8.34 | 1332 | 0.468 |

Fabrics with high denier per filament counts and multilobal filaments provide fabrics with increased thickness and the most open space. The fabrics of the present invention can be at least about ten deniers. Preferably, a fabric of the present invention is about twelve denier. In one example, a fabric with twelve denier, trilobal filaments is permeable and can be used alone in filtration applications or as a coarse layer in a composite filter. This fabric can also be used for needle punch applications. The increased thickness and open space of these fabrics can also hold coating material which is desirable in applications that use wax, adhesive, latex or other coatings.

The subject invention further concerns fabrics with mixed filament cross sections. These fabrics can be produced by, for example, installing spinnerets with capillaries of different cross sections on different positions, sides or beams of the machine. Spinnerets with different capillary cross sections or capillary sizes within the same spinneret can also be used.

The fabrics of the subject invention have more opacity, stronger tensile properties and hold more coating material than fabrics made with only round cross section filaments. For example, the trilobal filaments add strength by the way they pack on the fabric and add opacity by the way they reflect light. They also hold more coating material since trilobal filaments have more surface area. Similarly, a multilobal cross section also imparts these same or better desirable properties.

Fabrics made with twelve denier filament cross sections have more open areas than fabrics made with lower denier cross sections, thus yielding higher air permeability and better coating properties. Fabrics with twelve denier, trilobal cross section filaments have even better coating characteristics since they are more open and have higher surface area.

The fabrics of the subject invention can be produced by extruding a plurality of continuous filaments, directing the filaments through an attenuation device to draw the filaments, depositing the filaments onto a collection surface such that a web is formed, and bonding the filaments together either autogenously or thermally to form a coherent, strong fabric. For example, the filaments can be autogenously bonded to one another at discrete points throughout the fabric. Preferably, about 5% to about 50% of the filaments are bonded to one another at discrete points throughout the fabric. More preferably, about 18% to about 22% of the filaments are bonded to one another at discrete points throughout the fabric.

Typically, the filaments of the invention are composed of nylon or other man-made fibers from polymers such as polyester, polyolefins, polypropylene, polyethylene or other polyamides or combinations of such can be used. Also, mixtures of polymers can be used. Preferably, the nylon compound will be nylon 6,6 and/or nylon 6. In one embodiment, polyethylene, polypropylene, and/or polyester can be added to the nylon material. This produces a softer feel and increases water repellency. In the case of polyethylene, the polyethylene should have a melt index between about 5 grams/10 min and about 200 grains/10 min and a density between about 0.85 grains/cc and about 1.1 grams/cc. The polyethylene can be added at a concentration of about 0.05% to about 20%.

The filaments produced during the process of the subject invention may be bonded, for example, chemically, ultrasonically, or thermally. In one embodiment, HCl gas and water vapor can be applied to achieve bonding. In another embodiment, the filaments are heated to, for example, between 180° C. and about 250° C. Preferably, the filaments are heated to between about 200° C. and 235° C.

In one embodiment, a nonwoven fabric of the subject invention is made of a plurality of polymeric filaments bonded to one another to form a nonwoven web with a basis weight between about 0.2 ounces per square yard and about 7.0 ounces per square yard, and preferably comprises at least two different denier sizes of filaments such that the larger denier filaments comprise at least about 5% of the filaments. Preferably, the larger denier filaments of the fabric are at least about 1.5 times larger than the smaller denier filaments. More preferably, the larger denier filaments of the fabric are at least about twelve denier. In a preferred embodiment, a fabric of the invention comprises at least about 25% of larger multilobal or round filaments while the remaining filaments comprise smaller multilobal or round filaments. Preferably, the larger filaments are about twelve denier and the smaller multilobal filaments are five denier and the smaller round filaments are four denier.

In one embodiment, the nonwoven fabric of the invention comprises at least about 25% larger round and multilobal filaments, with at least about 5% large, multilobal filaments, the balance of the large filaments being of round cross section with the balance being smaller denier multilobal or round filaments or a combination of both. In a further embodiment, the nonwoven fabric of the invention comprises at least about 25% larger round and multilobal filaments, with at least about 5% large, round filaments, the balance of the large filaments being of multilobal cross section and the balance being smaller denier multilobal or round filaments. In a preferred embodiment, the larger filaments are either twelve denier multilobal or round filaments or both, and the smaller filaments are five denier multilobal or four denier round filaments or both.

The subject invention also concerns methods of producing a thicker more open nonwoven fabric. In one embodiment, the method comprises providing at least two different denier sizes of filaments such that the larger denier filaments are at least about 5% of the filaments and directing a plurality of these filaments onto a collection surface to form a web and forming a multiplicity of discrete bond sites in the fabric to bond together the large and small filaments. In one embodiment, the larger filaments of the fabric are produced by reducing the number of capillaries in at least about 5% of the spinnerets and maintaining a constant mass flow of polymer. In another embodiment, the larger filaments can be produced by changing the diameter or cross section of some of the capillaries within the spinnerets, or by reducing the amount of drawforce on undrawn larger filaments. Where the larger filaments are produced by reducing the amount of drawforce, the drawforce can be reduced, for example, by aspiration of undrawn filaments or by decreasing the distance between the spinneret and an attenuation device.

In the methods of the subject invention, the formation of discrete bond sites in the fabric to bond together the larger and small filaments can be accomplished by heating the web of filaments in discrete areas and forming thermal bonds. In a preferred embodiment, the discrete thermal bonds comprise from about 5% to about 50% of the fabric area. More preferably, the discrete thermal bonds comprise from about 16% to about 24% of the fabric area.

All patents, patent applications, provisional applications, and publications referred to or cited herein are incorporated by reference in their entirety to the extent that are not inconsistent with the explicit teachings of this specification.

Following are examples which illustrate procedures for practicing the invention. These examples should not be construed as limiting. All percentages are by weight and all solvent mixture proportions are by volume unless otherwise noted.

EXAMPLE 1

Seven fabric samples were made using nylon 6,6 polymer by installing eighty hole spinnerets with a round cross section on one side of the block fed by an extruder and thirty-two hole spinnerets with either a round or trilobal cross section on the other side. Twenty-eight and a half percent of the filaments of these seven fabric samples were twelve denier filaments. The nylon 6,6 polymer was melted and extruded at a temperature of about 295° C. Filaments were attenuated and drawn pneumatically using aspirating jets and deposited onto a laydown or forming box. The resulting webs were then directed to a calender where about 20% of the surface area was bonded at discrete points at a temperature of about 216° C. The thickness, air permeability and basis weights of these seven fabric samples are shown in Table 2. The average thickness, air permeability and basis weight of these fabrics are 7.74 mils, 1213 cubic feet per minute per square foot (cfm/ft$^2$) and 0.496 ounces per square yard (osy), respectively. The deniers per filament (DPF's), the maximum distance between filaments (MDBF) and the area of the holes in the fabric (HOLE AREA) were measured on two samples, items 34 and 44. Item 34 has DPF's of 11.4 for the round filaments and 3.7 for the trilobal filaments, an MDBF of 1185 microns and a HOLE AREA of 435,093 square microns. Item 44 has DPF's of 11.8 for the round filaments and 4.1 for the trilobal filaments, an MDBF of 761 microns and a HOLE AREA of 205,323 square microns.

TABLE 2

Properties of fabrics made with eighty and thirty-two hole spinnerets

| Item | Bottom Side of Fabric Cross Section | Bottom Side Spinneret Capillaries | Top Side Spinneret Capillaries | Thickness (mils) | Air Permeability (cfm/ft$^2$) | Basis Weight (osy) |
|---|---|---|---|---|---|---|
| 34 | ROUND | 32 | ROUND | 80 | 9.14 | 0.472 |
| 44 | TRILOBAL | 32 | ROUND | 80 | 8.78 | 0.514 |
| 64 | TRILOBAL | 32 | ROUND | 80 | 7.38 | 0.507 |
| 52 | ROUND | 80 | ROUND | 32 | 7.33 | 0.497 |
| 53 | ROUND | 80 | TRILOBAL | 32 | 7.53 | 0.514 |
| 72 | ROUND | 80 | ROUND | 32 | 7.20 | 0.515 |
| 73 | ROUND | 80 | TRILOBAL | 32 | 6.85 | 0.454 |

For comparison, six fabrics were made using the same process substituting eighty hole spinnerets with a round cross section on both sides of the machine. This fabric is currently available commercially under the trade name of "PBN-II" as Type 30 by CEREX Advanced Fabrics, L.P. The results of these fabrics are shown in Table 3. The average thickness, air permeability and basis weight of these fabrics are 6.48 mils, 1039 cfm/ft$^2$ and 0.490 osy, respectively. The DPF, MDBF and HOLE AREA were measured on one sample from this fabric set, item 82. Item 82 has a DPF of 5.0, an MDBF of 585 microns and a HOLE AREA of 108,400 square microns. Three more fabrics were made using the same process substituting eighty hole spinnerets with a round cross section on one side of the machine and a sixty-four hole spinneret with a trilobal cross section on the other side of the machine. The results of these fabrics are shown in Table 4. The average thickness, air permeability and basis weight of these fabrics are 6.45 mils, 1035 cfm/ft$^2$ and 0.540 osy, respectively. A third set of five fabrics was made similarly using the same process substituting sixty-four hole spinnerets with a trilobal cross section on both sides of the machine. This fabric is currently available commercially under the trade name of "PBN-II" as Type 31 by CEREX Advanced Fabrics, L.P. The results of these fabrics are shown in Table 5. The average thickness, air permeability and basis weight of these fabrics are 6.70 mils, 1069 cfm/ft$^2$ and 0.521 osy, respectively. The DPF's, MDBF and HOLE AREA were measured on one sample from this fabric set, item 13. Item 13 has a DPF of 5.0, an MDBF of 403 microns and a HOLE AREA of 78,450 square microns.

TABLE 3

Properties of fabrics made with eighty hole spinnerets

| Item | Bottom Side of Fabric Cross Section | Bottom Side Spinneret Capillaries | Top Side Spinneret of Fabric Cross Section | Top Side Spinneret Capillaries | Thickness (mils) | Air Permeability (cfm/ft$^2$) | Basis Weight (osy) |
|---|---|---|---|---|---|---|---|
| 54 | ROUND | 80 | ROUND | 80 | 7.10 | 1029 | 0.506 |
| 74 | ROUND | 80 | ROUND | 80 | 6.48 | 981 | 0.463 |
| 81 | ROUND | 80 | ROUND | 80 | 6.88 | 1014 | 0.529 |
| 82 | ROUND | 80 | ROUND | 80 | 5.83 | 1078 | 0.470 |
| 83 | ROUND | 80 | ROUND | 80 | 6.48 | 1050 | 0.491 |
| 84 | ROUND | 80 | ROUND | 80 | 6.15 | 1084 | 0.484 |

TABLE 4

Properties of fabrics made with eighty and sixty-four hole spinnerets

| Item | Bottom Side of Fabric Cross Section | Bottom Side Spinneret Capillaries | Top Side Spinneret of Fabric Cross Section | Top Side Spinneret Capillaries | Thickness (mils) | Air Permeability (cfm/ft$^2$) | Basis Weight (osy) |
|---|---|---|---|---|---|---|---|
| 24 | TRILOBAL | 64 | ROUND | 80 | 6.41 | 1049 | 0.530 |
| 51 | TRILOBAL | 80 | TRILOBAL | 64 | 6.45 | 1045 | 0.567 |
| 71 | ROUND | 80 | TRILOBAL | 64 | 6.50 | 1011 | 0.524 |

TABLE 5

Properties of fabrics made with sixty four hole spinnerets

| Item | Bottom Side of Fabric Cross Section | Bottom Side Spinneret Capillaries | Top Side Spinneret of Fabric Cross Section | Top Side Spinneret Capillaries | Thickness (mils) | Air Permeability (cfm/ft$^2$) | Basis Weight (osy) |
|---|---|---|---|---|---|---|---|
| 11 | TRILOBAL | 64 | TRILOBAL | 64 | 6.25 | 1114 | 0.536 |
| 12 | TRILOBAL | 64 | TRILOBAL | 64 | 6.88 | 1109 | 0.508 |
| 13 | TRILOBAL | 64 | TRILOBAL | 64 | 6.08 | 1117 | 0.511 |
| 14 | TRILOBAL | 64 | TRILOBAL | 64 | 7.10 | 1034 | 0.497 |
| 21 | TRILOBAL | 64 | TRILOBAL | 64 | 7.20 | 970 | 0.554 |

The average thickness of the seven fabrics listed in Table 2 was higher than all three fabric sets listed in Tables 3, 4, and 5. The thickness of a fabric made with eighty-hole spinnerets with a round cross section on one side of the block fed by an extruder and thirty-two hole spinnerets with either a round or trilobal cross section on the other side was 1.04 mills higher than the average of the Type 31 fabrics; 1.29 mills higher than the average thickness of the fabrics made with eighty hole spinnerets with a round cross section on one side of the machine and a sixty-four hole spinneret with a trilobal cross section on the other side of the machine and 1.26 mills higher than the average thickness of the Type 30 fabrics.

The average air permeability of the seven fabrics listed in Table 2 was higher than all three fabric sets listed in Tables 3, 4, and 5. The air permeability of a fabric made with eighty-hole spinnerets with a round cross section on one side of the block fed by an extruder and thirty-two hole spinnerets with either a round or trilobal cross section on the other side was 144 cfm/ft$^2$ higher than the average of the Type 31 fabrics; 178 cfm/ft$^2$ higher than the average air permeability of the fabrics made with eighty hole spinnerets with a round cross section on one side of the machine and a sixty-four hole spinneret with a trilobal cross section on the other side of the machine and 174 cfm/ft$^2$ higher than the average air permeability of the Type 30 fabrics. Fabrics made containing twenty-eight and a half percent twelve denier filaments had higher loft (thickness) and higher openness (air permeability) than fabrics made with four denier, round cross section filaments, fabrics made with five denier, trilobal cross section filaments or fabrics made with a mixture of four denier, round cross section and five denier, trilobal cross section filaments.

EXAMPLE 2

Five fabric samples were made using nylon 6,6 polymer by installing sixty-four hole spinnerets with a trilobal cross section on one side of the block fed by an extruder and thirty-two hole spinnerets with either a round or trilobal cross section on the other side. Thirty-three percent of the filaments of these five fabric samples were twelve denier filaments. The nylon 6,6 polymer was melted and formed into webs as described in Example 1. The thickness, air permeability and basis weights of these seven fabric samples are shown in Table 6. The average thickness, air permeability and basis weight of these fabrics are 8.32 mils, 1165 cfm/ft$^2$ and 0.509 osy, respectively. The DPF's, MDBF and HOLE AREA were measured on three samples from this fabric set, items 31, 41 and 23. Item 31 has DPF's of 5.3 for the trilobal filaments and 12.2 for the round filaments, an MDBF of 1037 microns and a HOLE AREA of 352,701 square microns. Item 41 has DPF's of 10.6 and 5.6, an MDBF of 437 microns and a HOLE AREA of 81,975 square microns. Item 23 has DPF's of 13.3 and 5.5, an MDBF of 730 microns and a HOLE AREA of 170,721 square microns.

The average thickness of the five fabrics listed in Table 6 was higher than all four fabric sets listed in Tables 2, 3, 4, and 5. The average thickness of fabric made with sixty-four hole spinnerets with a trilobal cross section on one side of the block fed by an extruder and thirty-two hole spinnerets with either a round or trilobal cross section on the other side was 1.62 mills higher than the average of the Type 31 fabrics; 1.87 mills higher than the average thickness of the fabrics made with eighty hole spinnerets with a round cross section on one side of the machine and a sixty-four hole spinneret with a trilobal cross section on the other side of the machine; 1.84 mills higher than the average thickness of the Type 30 fabrics and 0.58 mills higher than the average thickness of fabric made with eighty-hole spinnerets with a round cross section on one side of the block fed by an extruder and thirty-two hole spinnerets with either a round or trilobal cross section on the other side.

The average air permeability of the five fabrics listed in Table 6 was higher than all three fabric sets listed in Tables 3, 4, and 5. The air permeability of a fabric made with sixty-four hole spinnerets with a trilobal cross section on one side of the block fed by an extruder and thirty-two hole spinnerets with either a round or trilobal cross section on the other side was 96 cfm/ft$^2$ higher than the average of the Type 31 fabrics; 130 cfm/ft$^2$ higher than the average air permeability of the fabrics made with eighty hole spinnerets with a round cross section on one side of the machine and a sixty-four hole spinneret with a trilobal cross section on the other side of the machine and 127 cfm/ft$^2$ higher than the average air permeability of the Type 30 fabrics.

The average thickness of the five fabrics listed in Table 7 was higher than all four fabric sets listed in Tables 2, 3, 4 and 5. The average thickness of fabric made with thirty-two hole spinnerets with a trilobal or round cross section on one side of the block fed by an extruder and thirty-two hole spinnerets with either a round or trilobal cross section on the other side was 1.41 mills higher than the average of the Type 31 fabrics; 1.65 mills higher than the average thickness of the fabrics made with eighty hole spinnerets with a round cross section on one side of the machine and a sixty-four hole spinneret with a trilobal cross section on the other side of the machine; 1.62 mills higher than the average thickness of the Type 30 fabrics and 0.36 mills higher than the thickness of the average of fabric made with eighty hole spinnerets with a round cross section on one side of the block fed by an extruder and thirty-two hole spinnerets with either a round or trilobal cross section on the other side.

TABLE 6

Properties of fabrics made with sixty-four hole spinnerets and thirty-two hole spinnerets

| Item | Bottom Side of Fabric Cross Section | Bottom Side Spinneret Capillaries | Top Side Spinneret of Fabric Cross Section | Top Side Spinneret Capillaries | Thickness (mils) | Air Permeability (cfm/ft$^2$) | Basis Weight (osy) |
|---|---|---|---|---|---|---|---|
| 31 | TRILOBAL | 32 | TRILOBAL | 64 | 9.66 | 1185 | 0.537 |
| 41 | TRILOBAL | 32 | TRILOBAL | 64 | 9.03 | 1157 | 0.532 |
| 61 | TRILOBAL | 32 | TRILOBAL | 64 | 8.73 | 1084 | 0.485 |
| 22 | TRILOBAL | 64 | ROUND | 32 | 7.36 | 1204 | 0.527 |
| 23 | TRILOBAL | 64 | TRILOBAL | 32 | 6.82 | 1195 | 0.470 |

Fabrics made containing thirty-three percent twelve denier filaments had higher loft or thickness than fabrics made with four denier, round filaments, fabrics made with twenty-eight and a half percent twelve denier filaments. Fabrics made containing thirty-three percent twelve denier filaments. Fabrics made containing thirty-three percent twelve denier filaments had higher air permeability or openness than fabrics made with four denier, round filaments, fabrics made with five denier, trilobal filaments and fabrics made with a mixture of four denier, round and five denier, trilobal filaments.

EXAMPLE 3

Six fabric samples were made using nylon 6,6 polymer by installing thirty-two hole spinnerets with either a trilobal or round cross section on one side of the block fed by an extruder and thirty-two hole spinnerets with either a round or trilobal cross section on the other side. All of the filaments of these six fabric samples were twelve denier filaments. The nylon 6,6 polymer was melted and formed into webs as described in Example 1. The thickness, air permeability and basis weights of these seven fabric samples are shown in Table 7. The average thickness, air permeability and basis weight of these fabrics are 8.11 mils, 1371 cfm/ft$^2$ and 0.474 osy, respectively. The DPF's, MDBF and HOLE AREA were measured on three samples from this fabric set, items 32, 62 and 63. Item 32 has a DPF of 11.9, an MDBF of 3552 microns and a HOLE AREA of 3,492,177 square microns. Item 62 has DPF's of 12.6 for the trilobal filaments and 11.2 for the round filaments, an MDBF of 2766 microns and a HOLE AREA of 2,719,185 square microns. Item 63 has a DPF of 11.9, an MDBF of 1657 microns and a HOLE AREA of 835,938 square microns.

The average air permeability of the five fabrics listed in Table 7 was higher than all five fabric sets listed in Tables 2, 3, 4, 5, and 6. The air permeability of a fabric made with thirty-two hole spinnerets with either a round or trilobal cross section on one side of the block fed by an extruder and thirty-two hole spinnerets with either a round or trilobal cross section on the other side was 302 cfm/ft$^2$ higher than the average air permeability of the fabrics made with eighty hole spinnerets with a round cross section on one side of the machine and a sixty-four hole spinneret with a trilobal cross section on the other side of the machine; 332 cfm/ft$^2$ higher than the average air permeability of the Type 30 fabrics; 158 cfm/ft$^2$ higher than fabrics made with eighty hole spinnerets with a round cross section on one side of the block fed by an extruder and thirty-two hole spinnerets with either a round or trilobal cross section on the other side and 206 cfm/ft$^2$ higher than fabrics made with sixty-four hole spinnerets with a trilobal cross section on one side of the block fed by an extruder and thirty-two hole spinnerets with either a round or trilobal cross section on the other side cfm.

TABLE 7

Properties of fabrics made with thirty-two hole spinnerets

| Item | Bottom Side of Fabric Cross Section | Bottom Side Spinneret Capillaries | Top Side Spinneret of Fabric Cross Section | Top Side Spinneret Capillaries | Thickness (mils) | Air Permeability (cfm/ft$^2$) | Basis Weight (osy) |
|---|---|---|---|---|---|---|---|
| 32 | ROUND | 32 | ROUND | 32 | 7.47 | 1280 | 0.474 |
| 33 | ROUND | 32 | TRILOBAL | 32 | 8.39 | 1376 | 0.470 |
| 42 | TRILOBAL | 32 | ROUND | 32 | 7.93 | 1521 | 0.479 |
| 43 | TRILOBAL | 32 | TRILOBAL | 32 | 8.23 | 1301 | 0.468 |
| 62 | TRILOBAL | 32 | ROUND | 32 | 8.18 | 1387 | 0.487 |
| 63 | TRILOBAL | 32 | TRILOBAL | 32 | 8.45 | 1362 | 0.469 |

Fabrics made containing only twelve denier filaments had higher loft or thickness than fabrics made with four denier, round, filaments, fabrics made with five denier, trilobal filaments, fabrics made with a mixture of four denier, round and five denier, trilobal filaments or fabrics made with twenty-eight and a half percent twelve denier filaments with the remaining filaments being either four denier, round filaments or five denier, trilobal filaments. Fabrics made containing only twelve denier filaments had higher air permeability or openness than fabrics made with four denier, round filaments, fabrics made with five denier, trilobal filaments, fabrics made with twenty-eight and one half percent of the filaments being twelve denier filaments with the remaining filaments being either four denier, round filaments or five denier, trilobal filaments and fabrics made with one third of the filaments being twelve denier filaments with the remaining filaments being either four denier, round filaments or five denier, trilobal filaments.

EXAMPLE 4

The fabrics with twelve denier filaments from examples 1, 2, and 3 can be produced by decreasing the air pressure of specific jets or a slot device fed by spinnerets designed to produce higher denier filaments. The air pressure can be decreased sufficiently to reduce the draw force to produce the desired denier per filament in certain sections of the web.

EXAMPLE 5

The fabrics with twelve denier filaments from examples 1, 2 and 3 can be produced by decreasing the distance between the spinneret and the aspirating device, a jet or slot device, fed by spinnerets designed to produce higher denier filaments. The distance can be decreased sufficiently to reduce the drawforce to produce the desired denier per filaments in certain sections of the web.

It should be understood that the examples and embodiments described herein are for illustrative purposes only and that various modifications or changes in light thereof will be suggested to persons skilled in the art and are to be included within the spirit and purview of this application and the scope of the appended claims.

The invention claimed is:

1. A method of producing a thicker more open spunbonded nonwoven fabric, said method comprising providing at least two different denier sizes of continuous filaments, which comprise filaments that differ from each other in denier by a factor of at least 1.5, such that the larger denier filaments comprise at least about 5% of the filaments; directing a plurality of these filaments onto a collection surface to form a web; and forming a multiplicity of discrete bond sites in the fabric to bond together said different denier filaments, wherein said forming comprises autogenous without the presence of a binder; and wherein the different denier filaments are simultaneously spun from one or more spinnerets.

2. The method according to claim 1, wherein the different denier filaments are spun from at least two spinnerets; and wherein the larger filaments are produced by reducing the number of capillaries in at least about 5% of the spinnerets and maintaining a constant mass flow of polymer.

3. The method according to claim 1, wherein the larger filaments are produced by changing the diameter or cross section of some of the capillaries within the same spinneret.

4. The method according to claim 1, wherein the larger filaments are produced by reducing the amount of drawforce on the filaments leaving each of the spinnerets.

5. The method according to claim 4, wherein the amount of drawforce is reduced to produce larger filaments by reducing the aspiration of the filaments leaving each of the spinnerets.

6. The method according to claim 4, wherein the filaments pass through an attenuation device between the spinnerets and the collection surface; and wherein the amount of drawforce is reduced to produce larger filaments by decreasing the distance between each of the spinnerets and the attenuation device.

7. The method according to claim 1, further comprising drawing a plurality of said different denier filaments through an attenuation device to orient said different denier filaments prior to said directing.

* * * * *